US005651405A

United States Patent [19]

Boeddeker et al.

[11] Patent Number: 5,651,405

[45] Date of Patent: Jul. 29, 1997

[54] PORTABLE ACOUSTIC SHELL

[75] Inventors: David R. Boeddeker; Gary M. Benting; Leslie R. Abraham, all of Owatonna, Minn.

[73] Assignee: Wenger Corporation, Owatonna, Minn.

[21] Appl. No.: 390,744

[22] Filed: Feb. 16, 1995

Related U.S. Application Data

[63] Continuation-in-part of Ser. No. 290,700, Aug. 15, 1994, abandoned .

[51] Int. Cl.[6] ..... A47G 5/00

[52] U.S. Cl. ..... 160/135; 160/351; 181/30; 52/6

[58] Field of Search ..... 160/135, 351; 52/68, 69, 71; 5/56, 57.1, 57.2, 3, 6, 28; 181/30

[56] References Cited

U.S. PATENT DOCUMENTS 3,630,309 12/1971 Wenger et al. ..... 160/351
5,078,442 1/1992 Rau et al. ..... 52/69 X

*Primary Examiner*—Kenneth J. Dorner
*Assistant Examiner*—Bruce A. Lev
*Attorney, Agent, or Firm*—Patterson & Keough, P.A.

[57] ABSTRACT

An improved collapsible stage panel assembly having a base, a vertical panel rigidly attached to the base, an intermediate panel pivotally connected to the top of the rigid vertical panel, a canopy panel pivotally connected to the intermediate panel and a kicker panel pivotally connected to the bottom of the rigid vertical panel. The stage panel assembly has a mechanical assisting device between the rigid vertical panel and the intermediate panel to provide a counter balancing force against the combined weights of the intermediate and canopy panels. A second mechanical assisting device extends between the intermediate panel and the canopy panel to provide a counter balancing force against the weight of the canopy panel. An automatic locking device provides for the locking of the intermediate panel in its extended position relative to the rigid vertical panel when the intermediate panel is placed in its extended position. The improved panel assembly allows for easier conversion between the extended configuration of the panel assembly suitable for combination with other such assemblies to form an acoustic reflecting shell and the folded storage configuration where the panels can be nested together for storage in a minimum of space.

10 Claims, 4 Drawing Sheets

PORTABLE ACOUSTIC SHELL

This application is a continuation in part application of Ser. No. 08/290,700, filed Aug. 15, 1994 now abandoned.

FIELD OF THE INVENTION

This invention relates to stage panel assemblies and in particular to portable collapsible acoustic reflecting stage panel assemblies.

BACKGROUND OF THE INVENTION

A major factor and concern of the production and staging of performances for the theater, orchestras, chorus, etc., is the acoustical character that can be obtained in the building where the production is to take place. Conventional music halls and theaters are dedicated to providing the best possible acoustical environment and will have built in reflecting means as part of the building's structure. However, not even a dedicated conventional music hall would have the necessary adaptability with its built in reflecting means to accommodate different performance group sizes. Additionally, many performances are not produced in conventional music halls or theaters.

Often a facility for a performance will not include satisfactory sound reflecting means. This circumstance is true in both the conventional music hall or theater as well as other rooms such as gymnasiums, churches, meeting halls, convention centers, etc. There has developed a need for a low cost portable, collapsible, storable stage panel assembly which may be put up and arranged when and where desired to provide a desirable sound reflecting environment for the performers.

Portable sound shells are known in the industry. Examples include U.S. Pat. No. 3,180,446 issued to Wenger Apr. 27, 1965 and U.S. Pat. No. 3,630,309 issued to Wenger et al., Dec. 28, 1971. These patents disclose portable sound reflecting shells that are collapsible for convenient storage. However, these portable shell structures have proven difficult to use in some situations because of the weight distribution changes that occur during setup and take down of the units. Multiple people are required to work together with each unit to overcome the awkward and sometimes difficult intermediate stages of setup and take down. While these units have found wide acceptance, a more easily handled collapsible stage panel assembly would provide decided advantages.

SUMMARY OF THE INVENTION

This invention provides an improved stage panel assembly providing additional highly desirable features over and above known portable sound shells.

The present invention provides an improved collapsible stage panel assembly having a base, a generally vertical first panel rigidly attached to the base, a second panel pivotally connected to the first panel and selectively shiftable between a folded storage position and an extended position vertically extending from the top of the first panel, a third panel pivotally connected to the second panel and selectively shiftable between a storage position and an extended position at an angle relative to the top of the second panel and a kicker panel pivotally connected to the bottom of the first panel and selectively shiftable between an upward storage position and a downward extended position below the first panel. This stage panel assembly is further comprised of a counter balancing, first mechanical assisting device extending between the first fixed panel and the second foldable panel.

The first mechanical assisting device provides a counter balancing force biased against the combined weight of the second and third panels. An operator, using a first control handle operably connected to the second panel may ergonomically control the combined second and third panels from a collapsed folded storage position to a position with the second panel fully extended. The improved stage panel assembly also includes a second mechanical assisting device extending between the second panel and the third panel providing a counter balancing force against the weight of the third panel for selectively urging the third panel into the extended position from the collapsed folded storage position. This second mechanical assisting device allows an operator, using a second control handle operably connected to the third panel, to selectively extend and collapse the third panel relative to the first and second panels.

The improved stage panel assembly also includes an automatic locking device operably coupled between the first and second panels for automatically locking the second panel into its extended position relative to the first panel when an operator, using the first control handle, has extended the second panel into its upright position. The automatic locking device includes a manually controlled unlocking handle operably coupled to the automatic locking device for use by the operator to manually disengage the automatic locking device in preparation for collapsing the second panel relative to the bottom panel.

DETAILED DESCRIPTION OF THE DRAWINGS

Figure 1:
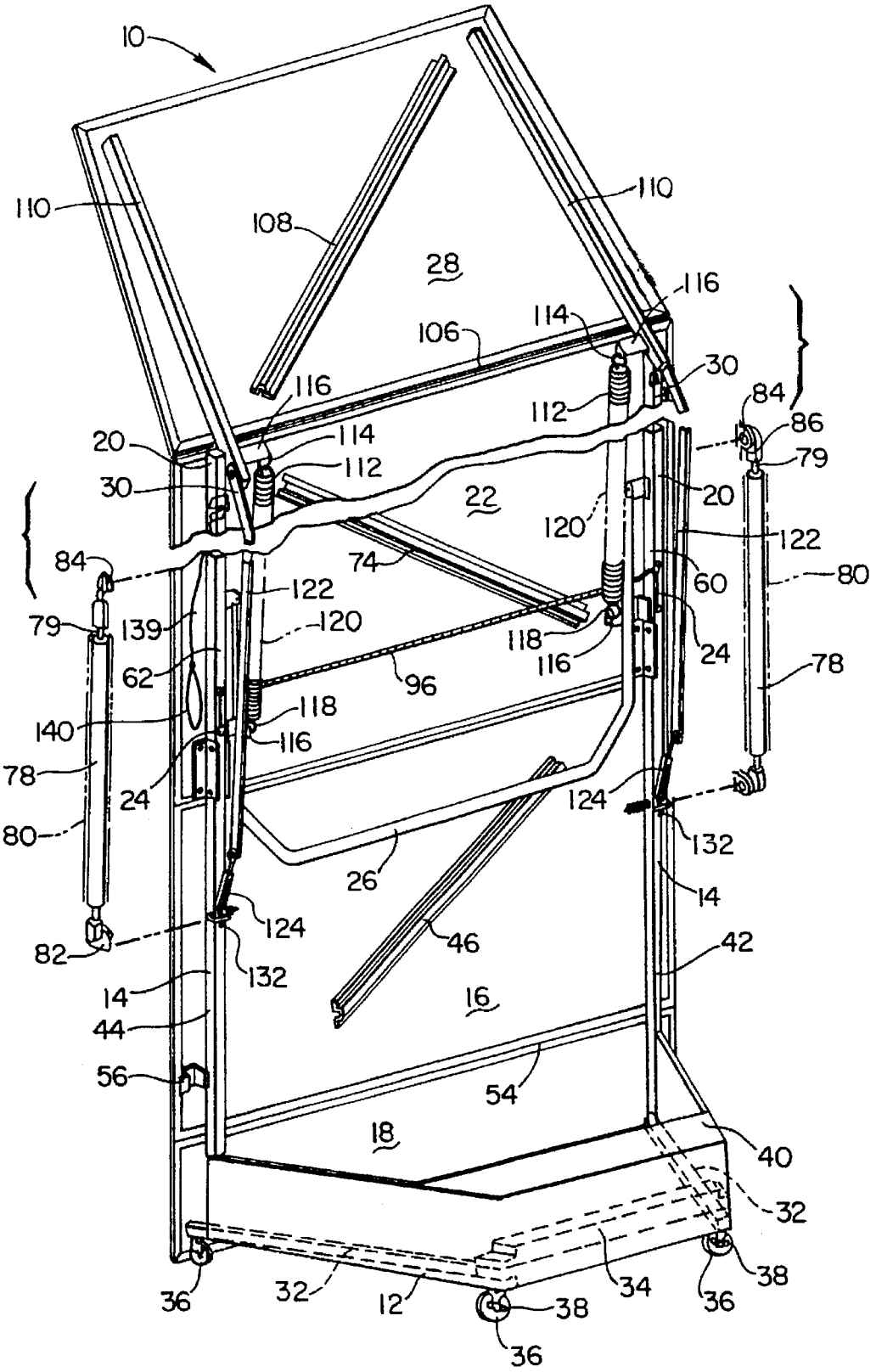
FIG. 1 is a rear perspective view of a portable acoustic assembly in accordance with the present invention in its extended position with the gas springs depicted in an exploded view.

A portable, sound reflecting acoustic assembly 10 is displayed in its erected, performance, configuration in FIG. 1. In its erected configuration, the acoustic assembly 10 can be placed in side-by-side relationship with other assemblies 10 to form a shell structure effective for reflecting sound in connection with the performing arts.

The acoustic assembly 10 broadly includes a base 12, a frame 14 rigidly attached to the base 12, a bottom panel 16, a kicker panel 18, a pivoting frame 20 supporting an intermediate panel 22, automatic locking mechanisms 24, a puller bar 26, a pivoting canopy panel 28 and an adjustable locking mechanism 30.

Figure 2:
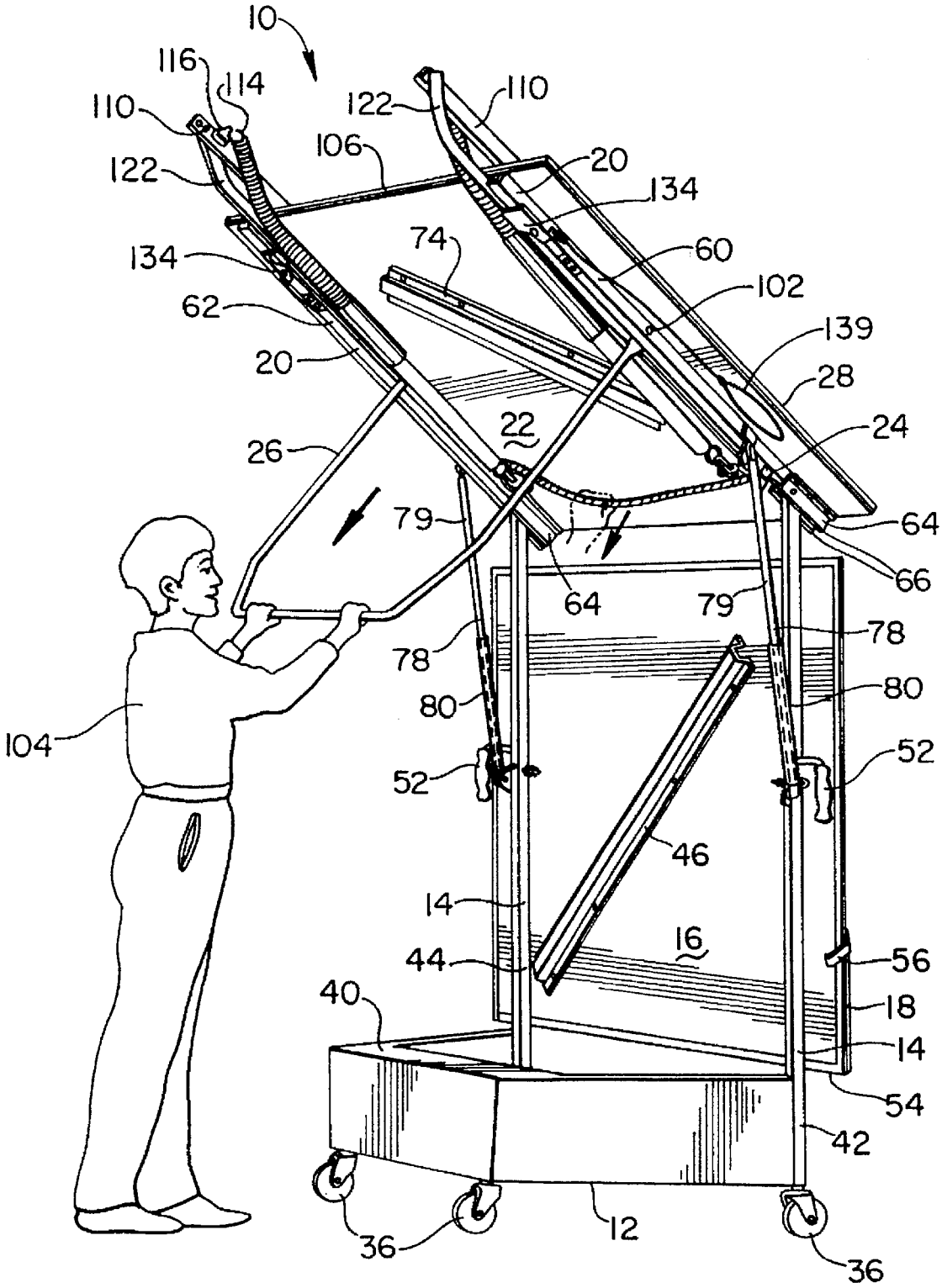
FIG. 2 is a rear perspective view of the portable acoustical assembly with the second intermediate panel in a partly raised position and with an operator depicted in the position of raising or lowering the foldable intermediate panel while the third, upper most panel is in a folded and locked position.

The base 12 includes sidepieces 32. A suitable counter weight 34 forms a rear crosspiece to the base 12. The sidepieces 32 angle inwardly toward the rear. The length of the counter weight 34 is substantially less than the distance between the sidepieces 32 measured at the front of the acoustic assembly 10. The weight of counter weight 34 is preselected to balance acoustic assembly 10 at all times, including when canopy panel 28 is angularly, forwardly disposed in the erected, performance position as in FIG. 1. The base 12 is provided with four suitable wheels or rollers 36 to facilitate movement of the acoustical assembly 10 to a desired location. The rearmost rollers 36 can be supplied with suitable locking brakes 38 to hold the acoustic assemblies in place when desired. The base 12 may be provided with a cover 40, as shown in FIGS. 1 and 2.

The frame 14 is comprised of a right upright 42 and a left upright 44. The bottom panel 16 is attached to uprights 42, 44. The bottom panel 16 can be provided with stiffener 46. The uprights 42, 44 are rigidly secured to base 12. The acoustic assembly 10 can be supplied with optional handles 52, depicted in FIG. 2, rigidly attached to uprights 42 and 44.

The kicker panel 18 is attached to the bottom panel 16 through a suitable hinge 54. The hinge 54 permits the kicker panel 18 to hang downwardly as shown in FIG. 1 or to be secured in an upward position by the retaining clips 56 as shown in FIG. 2. Alternatively, retaining straps with hook and pile couplings can be used in place of the clips 56. The retaining clips 56 can be stored on the stiffener 46 as shown in FIG. 1 when the retaining clips 56 are disengaged to allow the kicker panel 18 to hang downward. The kicker panel 18, in its lowered position, effectively hides the base 12 from the audience perspective of the front of acoustic assembly 10. When the kicker panel 18 is secured in its raised position, as depicted in FIG. 2, the open inner area of base 12 is exposed from the front of acoustic assembly 10 as depicted in FIG. 2 such that multiple assemblies 10 can be nested together for storage.

The pivoting frame 20 is comprised of a right upright extender 60 and a left upright extender 62. The upright extenders 60, 62 are connected to respective uprights 42, 44 by automatic locking mechanisms 24 that include hinges 64 and hinge connectors 66, as depicted in detail in FIGS. 3–5. The uprights 42, 44 are rigidly attached to pivot pin sleeves 68. Pivot pins 70 are received within sleeves 68 and are secured by nuts 72. A safety pin 73 is passed through bores 71 formed in hinge connectors 66 to ensure against inadvertent rotation of intermediate panel 22 out of the extended, performance position. The intermediate panel 22 is secured to the upright extenders 60 and 62. Intermediate panel 22 may be supplied with stiffener 74. The inner edge at the top of uprights 42, 44 is scored with ridge 76.

Referring again to FIGS. 1 and 2, gas springs 78 are operably attached to uprights 42, 44 by bolts 80 at brackets 82 and to upright extenders 60, 62 by bolts 84 at brackets 86. Gas springs 78 pivot around brackets 82, 86 to allow for the motion of the pivoting frame 20 while the gas springs 78 extend or contract. The gas springs 78 are depicted in an extended position in FIG. 2 with the intermediate panel 18 pivoted in position between its locked extended position and its downward lower position. Gas springs 78 have an extensible rod 79 shielded within a protective cover 80.

Figure 3:
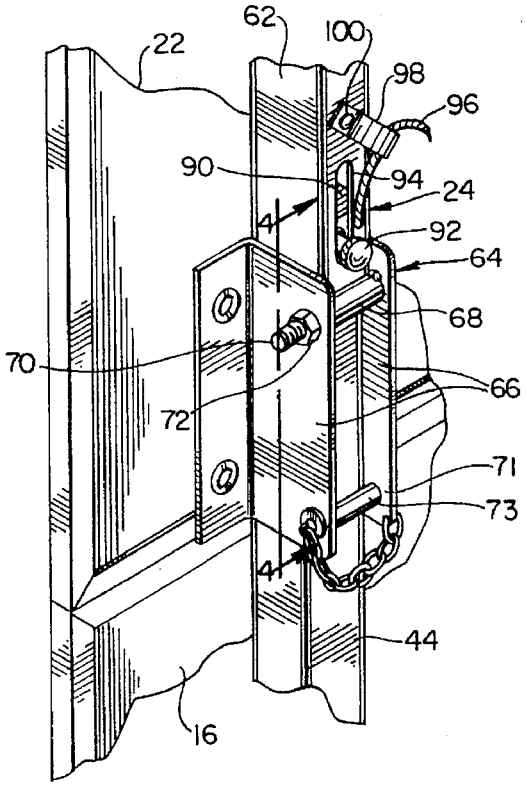
FIG. 3 is an enlarged, perspective view of one of the things joining the nonfoldable, lower panel and the foldable intermediate panel with the intermediate panel depicted in the extended upright position and the automatic locking mechanism in the locked position.
Figure 4:
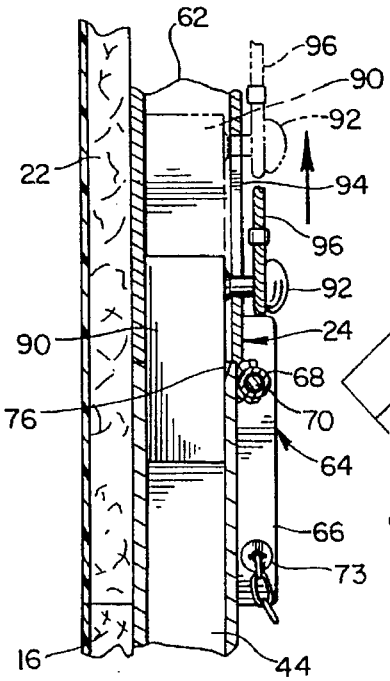
FIG. 4 is a sectional view taken along the line 4—4 of FIG. 3 with phantom lines depicting the locking mechanism in the unlocked position.
Figure 5:
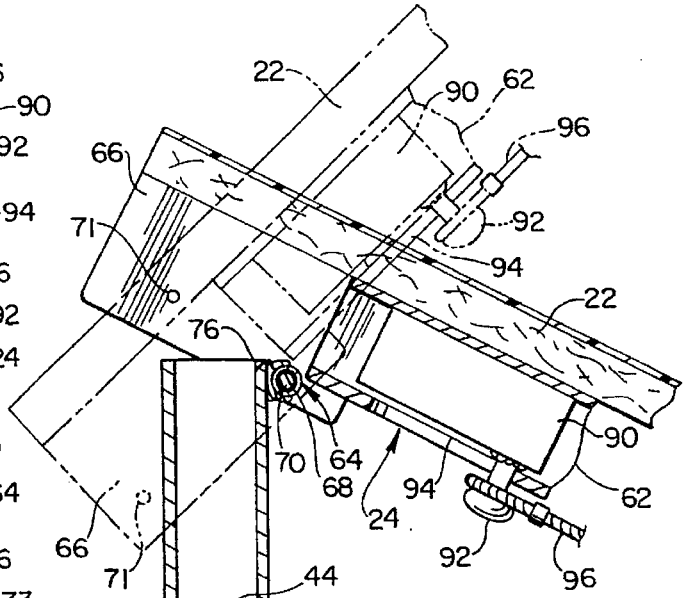
FIG. 5 is a fragmentary, sectional view of the automatic locking mechanism depicted in FIGS. 3 and 4, but with the hinge between the nonfoldable, lower panel and the foldable intermediate panel depicted in two partly folded positions, one in phantom, with the locking mechanism in a fully released position.

Referring to FIGS. 3, 4 and 5, the automatic locking mechanisms 24 are comprised of a slide bolt 90 and a lifter pin 92. The lifter pins 92 are rigidly attached to the slide bolts 90. Motion of the lifter pins 92 is restricted to be within retaining slots 94 within upright extenders 60, 62. A release cord 96 is connected to the lifter pins 92 and is directed by cord guides 98. The cord guides 98 are fixed to the uprights 60, 62 by screws 100. Slide bolts 90 act to lock upright extenders 60,62 in the vertical, performance position by engaging the uprights 42, 44. Accordingly, slide bolts 90 can be positioned in an unlocked position completely within the appropriate upright extender 60 or 62, as depicted in phantom in FIG. 4. Alternatively, slide bolts 90 can be positioned partially within upright extender 60 or 62 and partially extending beyond the end of the upright extender 60 or 62, as depicted in phantom in FIG. 5. Slide bolts 90 are partially positioned within upright 42 or 44 when the intermediate panel 22 is in its fully performance extended position, thereby locking uprights 42, 44 and upright extenders 60, 62.

Figure 6:
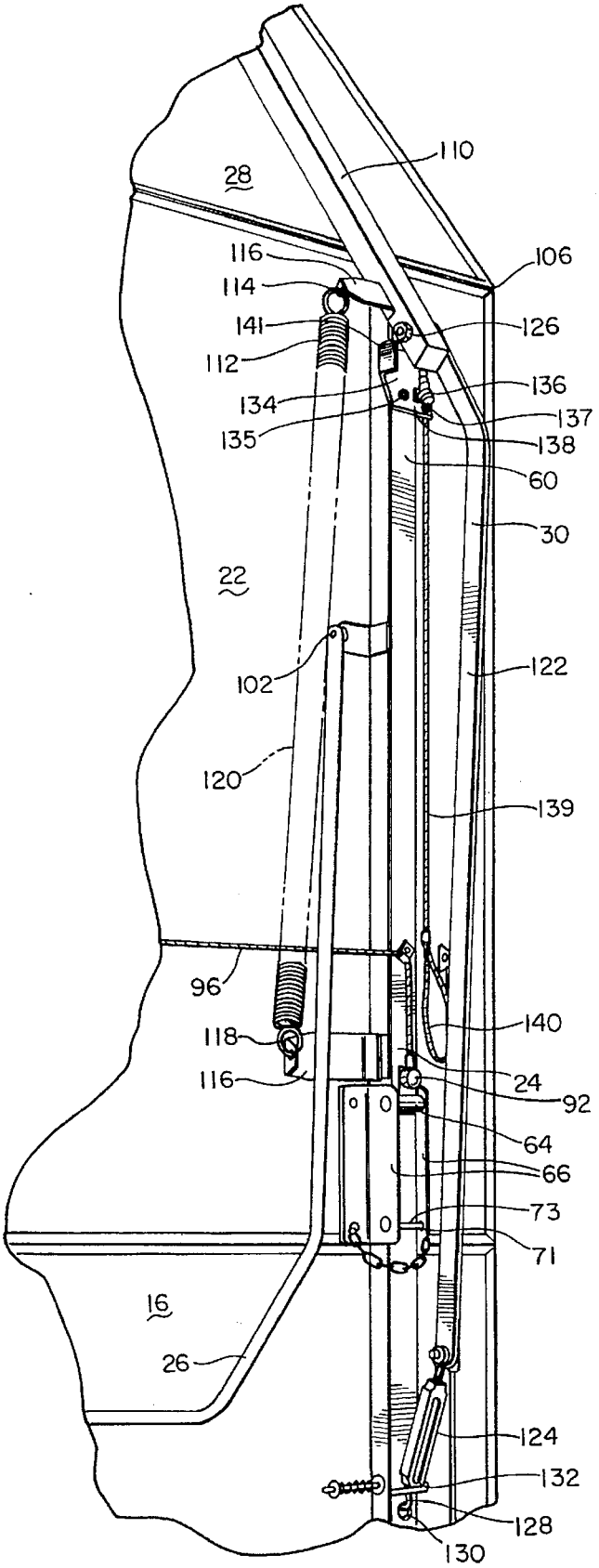
FIG. 6 is an enlarged, fragmentary, perspective view of the right adjustable locking mechanism with the canopy panel in its locked, extended position.

As depicted in FIGS. 1, 2 and 6, puller bar 26 rotates about pivots 102 to facilitate use of the puller bar 26 by an operator 104. The puller bar 26 can be seen in FIG. 1 in its stored position. In FIG. 2, the operator 104 is engaging puller bar 26.

Canopy panel 28 pivots relative to intermediate panel 22 at a hinge 106. Canopy panel 28 can pivot from a stowed position where the front face of canopy panel 28 is in contact with the front face of intermediate panel 22, as depicted in FIG. 2, to a fully extended performance position at an angle relative to the top of the intermediate panel 22, as depicted in FIG. 1. Canopy panel 28 may be provided with stiffener 108. Canopy panel 28 is secured to support brackets 110. Tension springs 112 are connected to support brackets 110 by connectors 114 and to brackets 116 by connectors 118. Brackets 116 are secured to intermediate panel 22. Sheaths 120 partially cover tension springs 112, in order to provide operator safety and to minimize the resonant vibration of springs 112 during a performance.

As depicted in FIG. 6, the adjustable locking mechanism 30 includes lifting arm 122 with suitable turnbuckle 124 at the lower end of the lifting arm 122. The lifting arm 122 is attached to the end of the support bracket 110 by bolt 126 allowing the pivoting of the lifting arm 122 with respect to support bracket 110. Hook 128 at the end of the turnbuckle 124 is engaged within receptacle 130 on upright extenders 60, 62. The spring loaded hooks 132 override hooks 128, thereby locking hooks 128 in receptacles 130.

A spring loaded locking bracket 134, depicted in FIG. 6, is provided to lock lifting arm 122 flush against the rear surface of intermediate panel 22 when canopy panel 28 is in the stowed position, as depicted in FIG. 2. Locking bracket 134 is pivotally mounted to upright extender 60, 62 by bolt 135. Locking bracket 134 is biased in the position depicted in FIG. 6 by spring 136. Spring 136 is affixed at a first end to upright extender 60, 62 by a bolt (not shown). The second end of spring 136 is attached to locking bracket 134 by a bolt 137.

The bolt 137 is attached to locking bracket 134 proximate the end of moment arm 138. Moment arm 138 is displaced from bolt 135 such that the tension in spring 136 exerts a rotational bias on locking bracket 134 in a counterclockwise direction, as depicted in FIG. 6.

Release cable 139 is also attached to moment arm 138 by bolt 137. Release cable 139 depends from moment arm 138. A loop 140 is formed in the free end of release cable 139 to facilitate the grasping thereof by an operator.

Angled face 141 is affixed to locking bracket 134 and forms an acute angle therewith. Angled face 141 is positioned far enough to the right of upright extender 60, as depicted in FIG. 6, that angled face 141 lies in the path of motion of lifting arm 122 as lifting arm 122 transitions from the position with canopy panel 28 deployed in the extended, performance position, as depicted in FIGS. 1 and 6, to the position with canopy panel 28 stowed as depicted in FIG. 2. In such transition, lifting arm 122 is caused to strike angled face 141 of locking bracket 134.

In operation, a plurality of acoustical assemblies 10 in their fully extended performance configuration can be placed in a side-by-side configuration to form effectively a portable wall defining a shell. This shell is generally useful for reflecting sound in connection with the performing arts, in applications such as choral shells, symphonic shells, shells suitable for reflecting sound with smaller groups such as dramatic groups, ensembles, etc. The arrangements are adjustable to accommodate different stage locations and different types of performing arts. The arrangements can be adjusted by varying the number of acoustic assemblies 10, their relative positions and the angular orientation of the canopy panels 28. The assemblies are on rollers 36 to allow for easy placement at the desired location. Handles 52 aid an operator rolling the acoustic assembly 10 to a desired location. The locking brakes 38 on the rear rollers 36 prevent motion once the assembly is in place.

FIG. 1 depicts an acoustic assembly in its fully deployed configuration as positioned for supporting a performance. In this configuration, kicker panel 18 hangs straight down below bottom panel 16, intermediate panel 22 is locked vertically above bottom panel 16 to form an essentially continuous, planar surface comprised of panels 16, 18 and 22, and the canopy panel 28 is locked by the hooks 128 attached to the turnbuckles 124 at the ends of the lifting arms 122 at an appropriately set angle. A suitable adjustment of turnbuckles 124 will set the angular position of the canopy panel 28 in its locked extended configuration relative to intermediate panel 22 along hinge 106.

To allow storage in a minimum amount of space, the acoustic assembly 10 is placed in its stowed configuration. In the stowed configuration, the canopy panel 28 is folded down upon the face of the intermediate panel 22, as depicted in FIG. 2. The intermediate panel 22 is folded down so that the rear faces of intermediate panel 22 and bottom panel 16 are adjacent. The kicker panel 18 is folded up exposing the inner part of the base 12. The narrowing arrangement of side pieces 32 of base 12 allows the unimpeded movement of the bases 12 of different acoustic assemblies 10 into the open inner area between side pieces 32. Therefore, for storage, a plurality of acoustic assemblies 10 can be nested with each other in close juxtaposition by movement of the base 12 of one assembly into the base 12 of a second assembly through the front of the second assembly. It is preferable that the total thickness of panels plus stiffeners is small relative to the depth of base 12, so that a plurality of assemblies can be stored in a minimum of space.

The structural features of the acoustic assemblies 10 provide for safe and easy conversion from the extended, performance configuration of the acoustic assemblies 10 to the stowed configuration by a single person. To perform the conversion, the canopy panel 28 is placed in lowered, clipped position, as depicted in FIG. 2. Then, the intermediate panel 24 is lowered and locked in place in its lowered position. Either before or after the lowering of the canopy panel 28 and the intermediate panel 22, the kicker panel 18 is placed in its raised position.

To facilitate the pivoting and locking of the canopy panel 28, adjustable locking mechanism 30 is provided with lifting arm 122. FIG. 6 displays the adjustable locking mechanism 30 with the canopy panel 28 in its locked extended performance position. To lower the canopy panel 28 from its extended position, spring loaded hook 132 is positioned to the right against the bias of the spring. Hook 128 at the end of turnbuckle 124 is the released from receptacle 130 on upright extender 60. The release of the hook 128 allows for motion of the lifting arm 122, which in turn allows the rotation of canopy panel 28 and the support brackets 110. As the canopy panel 28 is rotated into the stowed position, lifting arm 122 slidingly engages angled face 141 of locking bracket 134. The force exerted by lifting arm 122 against angled face 141 overcomes the countering force exerted by spring 136, causing locking bracket 134 to rotate in a clockwise direction. After lifting arm 122 passes beyond angled face 141, the spring 136 rotates locking bracket 134 in the counterclockwise direction, locking lifting arm 122 against the rear face of intermediate panel 22. Lifting arm 122 can be unlocked by pulling on release cable 139 to rotate locking bracket 134 clockwise to the unlocked position, freeing lifting arm 122.

Tension springs 112 provide a force tending to lift the canopy panel against the force of gravity into a more upright position. The springs 112, therefore, aid an operator in the raising of the canopy panel 28 and act to prevent the collapse of canopy panel 28 once the lifting arm 122 is released by releasing hook 128. The force of the tension springs 112 must be overcome in order to rotate canopy panel 28 to the stowed position. Tension springs 112 are partially covered with sheaths 120 to minimize possible injury from contact with the springs and to dampen acoustic vibration during performance. In the stowed position, the front face of canopy panel 28 is in contact with the front face of intermediate panel 22. Arm 122 is engaged with locking brackets 134 to prevent motion of the lifting arm 122 when canopy panel 28 is in its folded stowed position. In FIG. 2, the canopy panel 28 is locked in its stowed position. Tension springs 112 are in their most extended position.

Intermediate panel 22 can be locked into its upright performance position for use and locked into a lowered stowed position for storage. Upright extenders 60 and 62 are connected to hinges 64 allowing the pivoting of intermediate panel 22 with respect to bottom panel 16. FIG. 3 depicts the left side hinge 64 joining bottom panel 16 and intermediate panel 22. Pivoting of the intermediate panel 22 relative to the bottom panel 16 moves the canopy panel 28 along with the intermediate panel 22. Canopy panel 28 is locked in the stowed position during the pivoting of the intermediate panel 22.

Puller bar 26 is useful to control the pivoting of the intermediate panel 22 relative to the bottom panel 16 by allowing an operator to shift the relative balance between the elevating forces provided by the gas springs 78 and the downward forces from the weight of the intermediate panel 22 and the canopy panel 28. Gas springs 78 supply an extension force that is directed against the downward torque from the weight of the pivoting panels. In FIG. 2, an operator 104 is using puller bar 26 to provide leverage for the raising or lowering of the intermediate panel 22. The gas springs 78 go over center, providing a locking force holding the intermediate panel 22 and the canopy panel 28 in place in the extended, performance position.

The automatic locking mechanisms 24 are used to secure intermediate panel 22 in its upright, extended position relative to bottom panel 16. The release cord 94 is used to place the automatic locking mechanisms 24 in an unlocked position when the release cord is pulled inward relative to the ends of the cord. This action pulls the slide bolt 90 fully into the upright extenders 60, 62 and free of uprights 42, 44, as depicted in phantom in FIG. 4. Unlocking the automatic locking mechanism 24 allows the pivoting of the intermediate panel 22 relative to the bottom panel 16. Hand motion depicted by phantom lines in FIG. 2 depicts the pulling of release cord 94 to unlock the intermediate panel 16.

Referring now to FIG. 3, the automatic locking mechanism 24 is depicted in the locked position with the slide bolt 90 locking upright extender 62 to upright 44 and thereby preventing angular motion about the pivot pin 70 and the pivot pin sleeve 68. FIG. 4 depicts a sectional view of the automatic locking mechanism 24 with the lifter pin 92 and slide bolt 90 in two positions. The lower position of the lifter pin 92 and the slide bolt 90 is the locked position. In the locked position, the slide bolt 90 is partly within the upright extender 60 or 62 and partly within corresponding upright 42 or 44. The upper position of the lifter pin 92 and the slide bolt 90, shown with phantom lines, is the unlocked position. In the unlocked position, slide bolt 90 is completely within the appropriate upright extender 60 or 62 allowing angular motion about pivot pin 70 and pivot pin sleeve 68. The safety pin 73 prevents rotation of intermediate panel 22 even if the automatic locking mechanism 24 is in the unlocked configuration.

Referring to FIG. 5, a sectional view is depicted comparable to FIG. 4 except that the intermediate panel 22 is at two intermediate positions relative to the bottom panel 16 that are attained during the folding/unfolding process. In the first position, depicted in solid lines, intermediate panel 22 is oriented slightly below the perpendicular relative to bottom panel 16. In the second position, which depicted in phantom lines, intermediate panel 22 is oriented slightly above the perpendicular. For both orientations of the intermediate panel 22, the slide bolt 90 is withdrawn completely within the appropriate upright 60 or 62.

In orientations below the perpendicular, the force of gravity will tend to slip the slide bolt 90 further into the appropriate upright extender 60 or 62 and away from the direction of the hinge connector 66. In orientations above the perpendicular, the force of gravity will tend to force the slide bolt 90 toward and past the end of the appropriate upright extender 60 or 62. If the intermediate panel 22 is in the upright orientation, a first portion of the slide bolt 90 enters uprights 42, 44 and a second portion of the slide bolt 90 remains within the upright extenders 60, 62, in order to place the automatic locking mechanism 24 in its locked position.

The base and frame uprights may be formed from heavy tubular steel for improved rigidity. The wall panels may be formed from conventional high density acoustic material provided with a suitable finish.

We claim:

1. A portable, collapsible stage panel assembly being shiftable between a stored disposition and an extended performance disposition and having a plurality of panels, each of said panels presenting a forward directed face for presentation to an audience and a rearward directed face having a plurality of components disposed thereon for assisting in shifting the stage panel assembly between the folded stored disposition and the extended performance disposition, comprising:

a base;

a generally vertical first panel presenting a top margin and a bottom margin and being rigidly attached to said base;

a second panel pivotally connected to said first panel and selectively shiftable between a folded storage position and an extended performance position vertically extending from the top margin of said bottom panel;

a third panel presenting a top margin and a bottom margin and being pivotally connected to said second panel and selectively shiftable between a folded storage position and an extended performance position at an angle relative to said second panel, said third panel having a plurality of support brackets, each of said support brackets presenting a cantilever portion extending beyond the bottom margin of the third panel;

a first mechanical assisting means, operably coupling said second panel to said first panel, for moderating the shifting of said second panel relative to said first panel to assist an operator in extending or storing said second panel and for over-center locking of said second panel in the extended performance disposition;

second mechanical assisting means, having biasing means operably coupling said third panel to said second panel, said biasing means having a first end operably coupled to said second panel and having a second end operably coupled to the cantilever portion of a selected third panel support bracket, the second mechanical assisting means for moderating the shifting of said third panel relative to said second panel to assist an operator in extending or storing said third panel;

a first pivotable control handle operably coupled to said second panel for controlling the shifting of said second panel relative to said first panel between said folded storage position and said extended position, having a first end operably pivotally coupled to said second panel proximate a first side thereof and a second end operably pivotally coupled to said second panel proximate a second side thereof; and wherein said first and second mechanical assisting means provide for ergonomic opening and closing of the collapsible stage panel assembly.

2. The assembly of claim 1 in which said first mechanical assisting means comprises at least two counter-balancing compression biased gas springs, each of the gas springs having a first end operably pivotally coupled to a first rearwardly directed bracket and a second end operably pivotally coupled to a second rearwardly directed bracket for accommodating shifting said second panel to the extended performance disposition.

3. The assembly of claim 1 in which said second mechanical assisting means comprises at least two tension springs, each of said springs being at least partially sheathed, the sheaths for dampening resonant vibration induced in said springs.

4. A portable, collapsible stage panel assembly comprising:

a base;

a generally vertical first panel presenting a top margin and a bottom margin and being rigidly attached to said base;

a second panel pivotally connected to said first panel and selectively shiftable between a folded storage position and an extended position vertically extending from the top margin of said bottom panel;

a third panel pivotally connected to said second panel and selectively shiftable between a folded storage position and an extended position at an angle relative to the top margin of said second panel;

a first mechanical assisting means, operably coupling said second panel to said first panel, for moderating the shifting of said second panel relative to said first panel to assist an operator in extending or storing said second panel;

second mechanical assisting means, operably coupling said third panel to said second panel, for moderating the shifting of said third panel relative to said second panel to assist an operator in extending or storing said third panel;

a first control handle operably coupled to said second panel for controlling the shifting of said second panel relative to said first panel between said folded storage position and said extended position;

wherein said first and second mechanical assisting means provide for ergonomic opening and closing of the collapsible stage panel assembly; and an automatic locking means for locking said second panel in said extended position when said second panel is lifted with said first control handle said automatic locking means comprising a slide bolt and an unlocking handle.

5. The assembly of claim 4 in which said slide bolt is gravity operated.

6. A portable, collapsible stage panel assembly comprising:

a base;

a generally vertical first panel presenting a top margin and a bottom margin and being rigidly attached to said base;

a second panel pivotally connected to said first panel and selectively shiftable between a folded storage position and an extended position vertically extending from the top margin of said bottom panel;

a third panel pivotally connected to said second panel and selectively shiftable between a folded storage position and an extended position at an angle relative to the top of said second panel;

a first mechanical assisting means, operably coupling said second panel to said first panel, for moderating the shifting of said second panel relative to said first panel to assist an operator in extending or storing said second panel;

second mechanical assisting means, operably coupling said third panel to said second panel, for moderating the shifting of said third panel relative to said second panel to assist an operator in extending or storing said third panel;

a first control handle operably coupled to said second panel for controlling the shifting of said second panel relative to said first panel between said folded storage position and said extended position;

wherein said first and second mechanical assisting means provide for ergonomic opening and closing of the collapsible stage panel assembly; and an automatic locking means for locking said second panel in said extended position when said second panel is lifted with said first control handle said locking means having at least two first channel frames coupled to a surface of said first panel, said first channel frames having essentially hollow cores; and at least two second channel frames coupled to a surface of said second panel, having essentially hollow cores and a slide bolt slidably engaged within each hollow core, said second channel frames being operably aligned with said first channel frames permitting the slide bolts to selectively slide incrementally through said second channel frame cores and operably engage said first channel frames.

7. The assembly of claim 6 in which the locking means includes an unlocking handle operably interconnected to each slide bolt for operably disengaging each slide bolt from the first channel frame cores.

8. The assembly of claim 7 in which said unlocking handle is constrained to move by retaining slot within said second channel frame.

9. A portable, collapsible stage panel assembly comprising:

a base;

a generally vertical first panel presenting a top margin and a bottom margin and being rigidly attached to said base;

a second panel pivotally connected to said first panel and selectively shiftable between a folded storage position and an extended position vertically extending from the top margin of said bottom panel;

a third panel pivotally connected to said second panel and selectively shiftable between a folded storage position and an extended position at an angle relative to the top of said second panel;

a first mechanical assisting means, operably coupling said second panel to said first panel, for moderating the shifting of said second panel relative to said first panel to assist an operator in extending or storing said second panel;

second mechanical assisting means, operably coupling said third panel to said second panel, for moderating the shifting of said third panel relative to said second panel to assist an operator in extending or storing said third panel, said second mechanical assisting means comprising at least two counter-balancing extension biased springs;

a first control handle operably coupled to said second panel for controlling the shifting of said second panel relative to said first panel between said folded storage position and said extended position; and wherein said first and second mechanical assisting means provide for ergonomic opening and closing of the collapsible stage panel assembly.

10. The assembly of claim 9 in which said second mechanical assisting means further comprise protective sheaths over each spring.

* * * * *

UNITED STATES PATENT AND TRADEMARK OFFICE

CERTIFICATE OF CORRECTION

PATENT NO. : 5,651,405
DATED : July 29, 1997
INVENTOR(S) : Boeddeker et al.

It is certified that error appears in the above-indentified patent and that said Letters Patent is hereby corrected as shown below:

Column 6, line 6, delete "the" and insert --then--.

Column 9, line 55, after "having" insert --:--.

Column 10, line 16, after "by" insert --a--.

Signed and Sealed this

Twenty-fourth Day of February, 1998

*Attest:*

Bruce Lehman

BRUCE LEHMAN

*Attesting Officer*

*Commissioner of Patents and Trademarks*